United States Patent [19]

Cherniak

[11] Patent Number: 4,967,750

[45] Date of Patent: Nov. 6, 1990

[54] MODULAR ORTHOPEDIC SANDAL

[76] Inventor: Jaime G. Cherniak, Ave. Tiradentes No. 10, Centro, Commercial Dalyn, Ens. Naco, Santo Domingo, Dominican Republic

[21] Appl. No.: 113,458

[22] Filed: Oct. 28, 1987

[51] Int. Cl.[5] ..... A61F 5/14; A43B 7/14; A43B 3/12

[52] U.S. Cl. ..... 128/581; 128/586; 36/11.5

[58] Field of Search ..... 36/11.5, 100, 101; 128/581, 582, 586, 596, 81 R

[56] References Cited

U.S. PATENT DOCUMENTS

| | | | |
|---|---|---|---|
| 4,300,294 | 11/1981 | Riecker | 36/11.5 X |
| 4,348,820 | 9/1982 | D'Alessio | 36/11.5 X |
| 4,439,935 | 4/1984 | Kelly | 36/11.5 X |
| 4,563,787 | 1/1986 | Drew | 128/581 X |
| 4,694,831 | 9/1987 | Seltzer | 36/11.5 X |
| 4,742,625 | 5/1988 | Syder et al. | 36/11.5 X |

*Primary Examiner*—Edgar S. Burr
*Assistant Examiner*—Kimberly L. Asher
*Attorney, Agent, or Firm*—Darby & Darby

[57] ABSTRACT

The present invention provides a modular orthopedic sandal. The modular orthopedic sandal includes an insole and a sole. The sole has a top surface recessed below its top peripheral edge to form a sidewall surrounding the top surface. The insole is attached to a groove within the sidewall on the top surface. An orthopedic appliance is attached to the sole between the insole and the top surface of the sole. In a preferred embodiment the sole member has a transverse channel and a detachable central member, releasably attached to the sole within the channel. An arch strap is connected to the sole at the top of the central member within the channel. The arch strap is sized to encircle the foot to attach the sole to the foot. The arch strap is preferably inelastic and functions to decrease the flexibility of the sole to provide increased support for the arch of the foot.

13 Claims, 8 Drawing Sheets

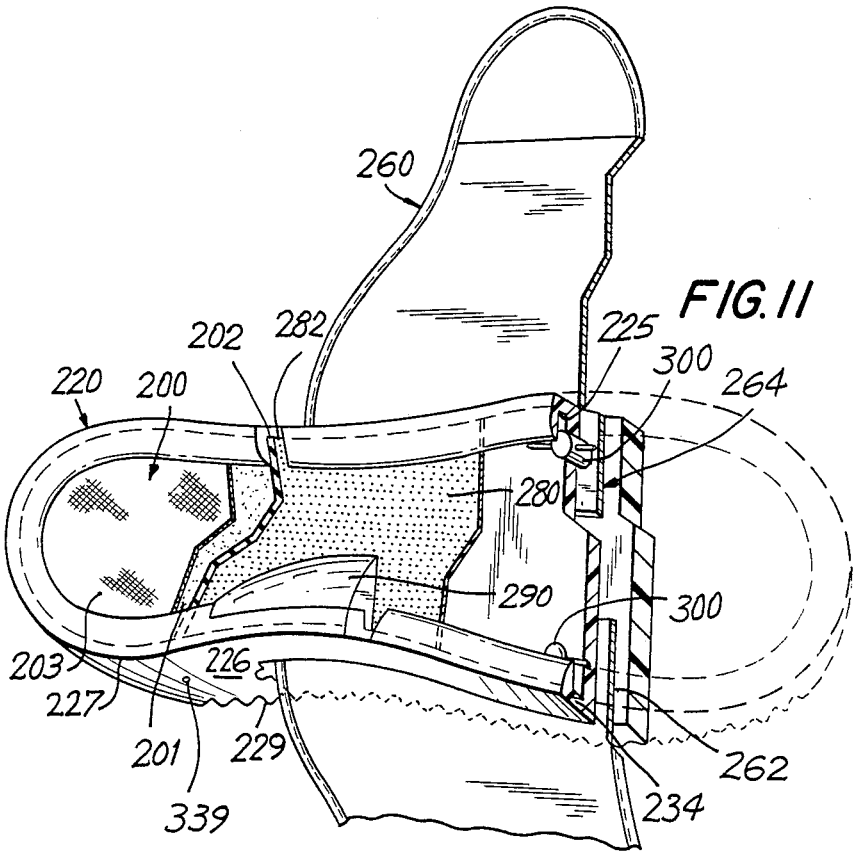
FIG. 11
FIG. 10
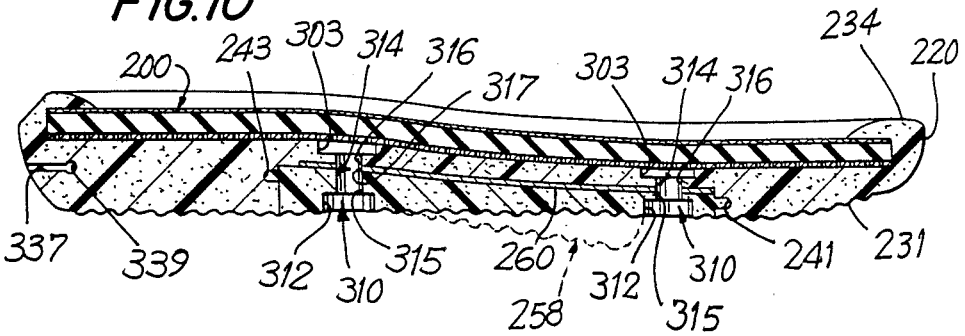

MODULAR ORTHOPEDIC SANDAL

BACKGROUND OF THE INVENTION

Orthopedic appliances are prescribed by podiatrists and related health care professionals to provide additional support to selected regions of the foot. While such orthopedic appliances are often secured to the insoles of conventional shoes, they can also be secured to the insoles of sandals. For instance, U.S. Pat. No. 4,603,698, issued to Cherniak (the inventor herein) on Aug. 5, 1986, provides an arch support secured to an insole-like base plate. The base plate and arch support are attached to a shoe-like sandal. Another example is U.S. Pat. No. 1,867,679, issued to Riehle et al on July 19, 1932, which provides a foot corrective sandal having orthotic appliances, such as a bunion-and bracing pad, nailed to the sole of a sandal.

As can be appreciated, when an orthopedic appliance is secured to a sandal, the orthopedic appliance is visible. A segment of the market finds this combination to be unattractive. Since the selection of footwear is, to a large extent, based on aesthetic considerations, some potential purchasers, needing orthopedic footwear, do not purchase sandals incorporating visible orthopedic appliances. The present invention seeks to fulfill the need of this portion of the marketplace by providing a modular orthopedic sandal having attractive, supporting orthopedic components incorporated into its design. Additionally, the modular construction of the orthopedic sandal of the present invention allows the orthopedic appliances to be concealed within the sandal and, thus, not visible.

SUMMARY OF THE INVENTION

The present invention provides, in a basic form, a modular orthopedic sandal, having an assemblage of modular members that comprise a flexible insole, a resilient, flexible sole, at least one orthopedic appliance and means for attaching the one orthopedic appliance to the sole. The sole is operable to be releasably attached to the insole. The sole includes a length as measured between the ends of the sole, an outer lateral surface, a top surface, a bottom surface, an upstanding sidewall, means for releasably attaching the insole to the sidewall, and means for securing the sole to a foot of a user. The outer lateral surface has a lower peripheral edge and an upper peripheral edge spaced above the lower peripheral edge. The bottom surface is bounded by the lower peripheral edge. The top surface is spaced above the bottom surface and recessed below the upper peripheral edge. The upstanding sidewall has an inner surface surrounding and adjacent to the top surface, a top peripheral edge formed by the upper peripheral edge and an outer surface formed by a portion of the outer lateral surface located between the upper peripheral edge and the top surface. The insole releasable attachment means attach the insole to the sidewall above the top surface. The orthopedic appliance is operable to be located between the insole and the top surface and to be surrounded by the sidewall. The orthopedic appliance attachment means attach the orthopedic appliance to the sole below the insole. As a result, the orthopedic appliance is concealed between the insole, the top surface and the sidewall.

DESCRIPTION OF THE DRAWINGS

In the accompanying drawings:

FIG. 10 is a cross-sectional view taken along lines 8—8 of FIG. 2.

FIG. 11 is a fragmentary, perspective view of the modular orthopedic sandal illustrated in FIG. 2 with portions of an insole, a sole, an insole-like base plate of the present invention removed and with the arch strap of the present invention separated.

DETAILED DESCRIPTION

Figure 1:
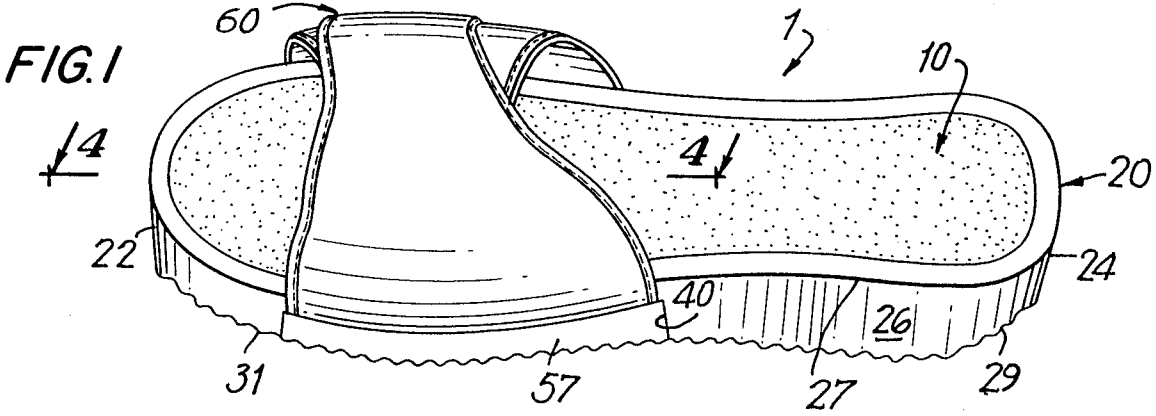
FIG. 1 is a perspective view of a preferred embodiment of an assembled modular orthopedic sandal of the present invention.
Figure 2:
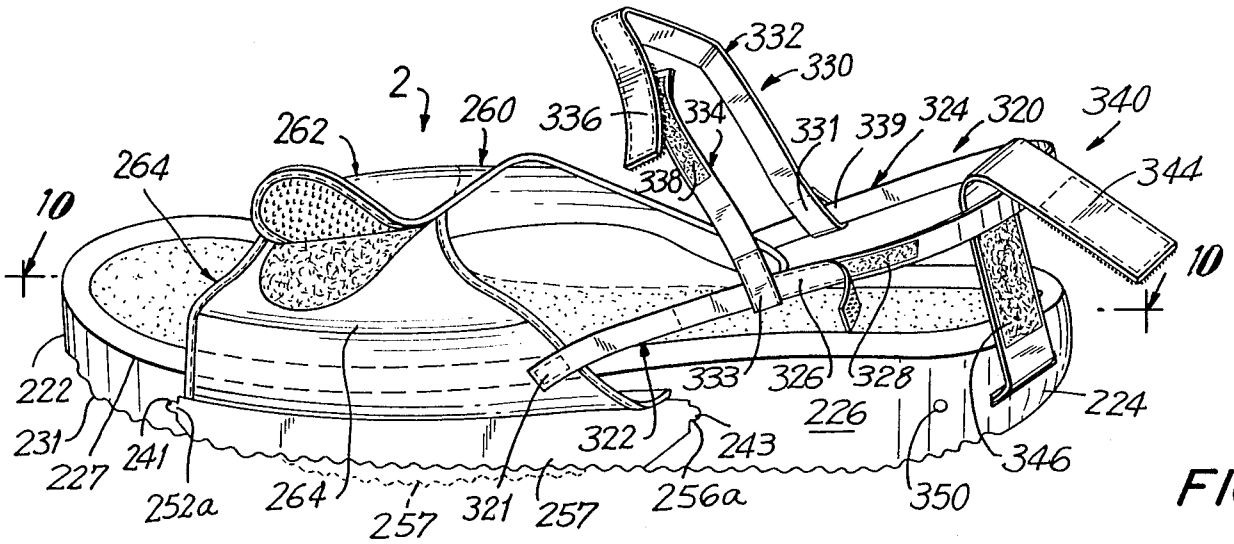
FIG. 2 is an alternative preferred embodiment of an assembled modular orthopedic sandal of the present invention.
Figure 3:
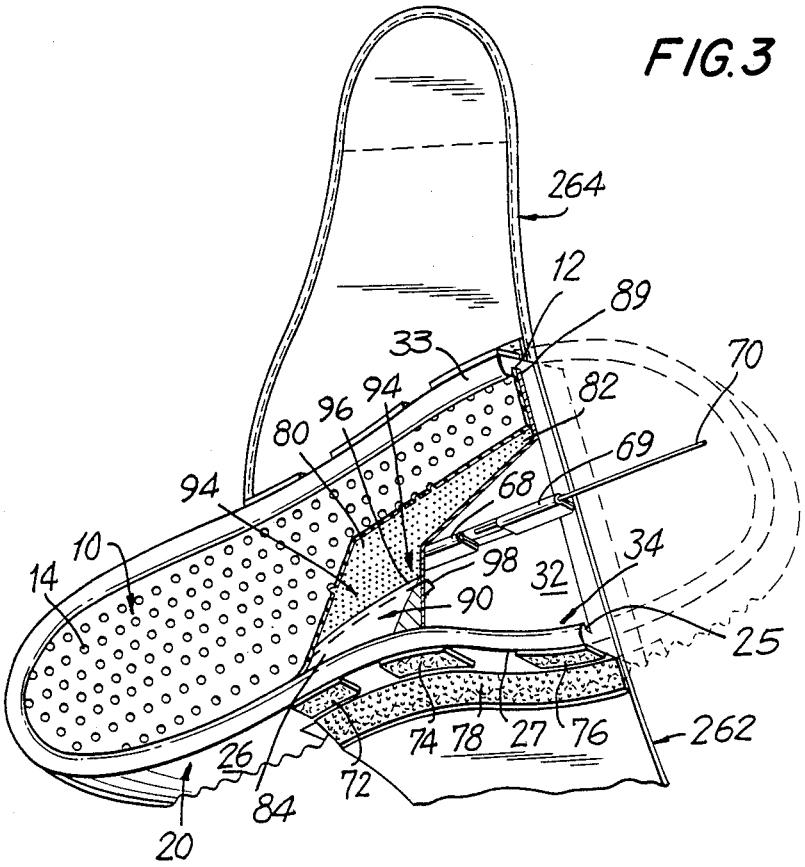
FIG. 3 is a fragmentary, perspective view of the modular orthopedic sandal of FIG. 1 with portions of an insole, a sole and an insole-like base plate of the present invention removed and with an arch strap of the present invention separated.
Figure 4:
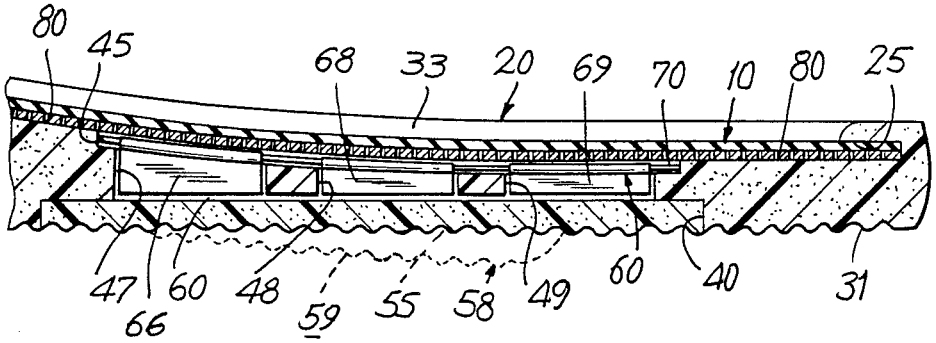
FIG. 4 is a fragmentary cross-sectional view of the modular orthopedic sandal of FIG. 1 taken along line 4—4 of FIG. 1.
Figure 5:
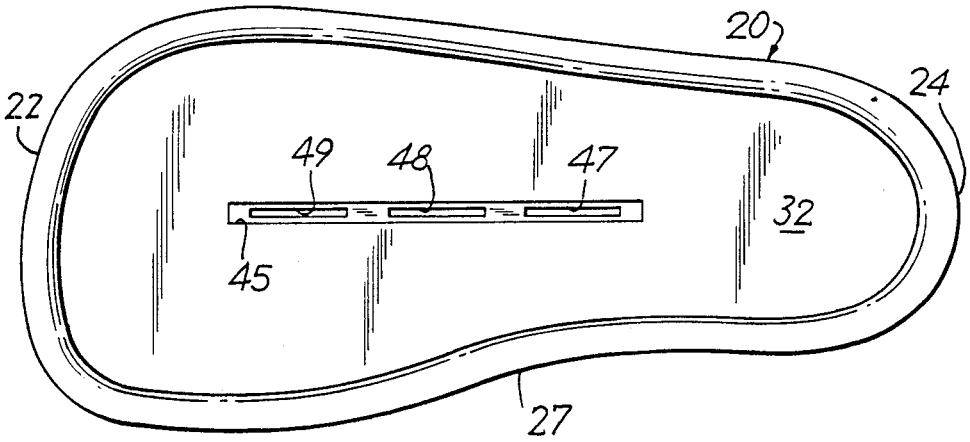
FIG. 5 is a top plan view of the sole of the present invention utilized in the embodiment illustrated in FIG. 1.

FIGS. 1 and 2 illustrate two embodiments 1 and 2 of the modular orthopedic sandal of the present invention. The sandal 1 illustrated in FIG. 1, includes an insole 10 releasably attached to a sole 20. With reference now also to FIGS. 3 and 4, the preferred means for this attachment is an inner peripherally extending groove 25 within a sidewall 34 of the sole 20. Concealed between the insole 10 and the sole 20 is an insole-like base plate 80 having an independently attachable orthopedic appliance 90 secured thereto. The base plate 80 and orthopedic appliance 90 are also attached to the sole member 20 by the preferred means of the groove 25 within the sidewall 23. The sandal 1 is preferably attached to the user's foot by means of an arch strap 60. The present invention can optionally further provide a detachable central member 50 that is releasably attached within a transverse channel 40 of the sole 10. The arch strap 60 is attached to the central member 50 and thus also extends through the channel 30. The sandal 2 of FIG. 2 incorporates, with some modifications, operative components that correspond to the components of FIG. 1 described above.

Having briefly described the subject invention, a more detailed description begins with the sandal 1 illustrated in FIG. 1. With reference to FIGS. 1, 3, 5, and 6, the insole 10 is preferably fabricated from a flexible material such as rubber or plastic and has a first outer peripheral edge 12. The insole 10 can optionally include a plurality of holes 14 to allow for ventilation of the foot. The sole 20 is preferably formed from a resilient, flexible material such as foam plastic or other rubber-like material, such as is conventionally used in the manufacture of sandals. The sole 20 is located against the insole 10. Sole 20 has a length as measured between its ends 22 and 24. Sole 20 has an outer lateral surface 26 having an upper peripheral edge 27 and a lower peripheral edge 29. Upper peripheral edge 27 is spaced above edge 29. A bottom surface 30 of the sole 20 is bounded by the lower peripheral edge 29. The top surface 32 is spaced above the bottom surface 30 and is recessed below the upper peripheral edge 29. An upstanding sidewall 34 surrounds the top surface 32. This sidewall 34 is formed by the recessed top surface 32; and as such, an inner surface 33 of the sidewall 34 surrounds and is adjacent to the top surface 32. The top peripheral edge of the sidewall 34 is formed by the upper peripheral edge 27 of the outer lateral surface 26. The inner surface 33 of the sidewall 34 preferably has an inner, peripherally extending groove 25 level with the top surface 32 and oriented outwardly towards the outer surface of the sidewall 34 (which is formed by a portion of the outer lateral surface 26 located between upper peripheral edge 27 and top surface 32). The first outer peripheral edge 12 of the insole 10 is configured to seat within the groove 25. The orthopedic appliance 90 is concealed between the top surface 32, the insole member 10 and the sidewall 34. The preferred method utilized in the present invention for attaching an orthopedic appliance, such as illustrated by 90 is accomplished by the means of an insole-like base plate 80. Briefly, the insole-like base plate 80 is fabricated from a stiffly flexible material which can be plastic or metal. Base plate 80 is provided with a plurality of hole-like mounting sites 82. The orthopedic appliance 90 is attached to the base plate 80 by means of U-shaped, staple-like wires 94, having central portions 96 embedded in the orthopedic appliance and spaced, extending portions 98 which project through the hole-like mounting sites 82 and are crimped inwardly against the base plate 80. The base plate 80, utilized with the present invention, preferably has a second outer peripheral edge 89 that is configured to align with the first outer peripheral edge 12 when base plate 80 is placed below insole 10. The second outer peripheral edge 89 and the first outer peripheral edge 12 are configured to seat within slot 25 and, thus, the base plate 80 is secured to the sole below the insole 10 and against the top surface 32.

Although the use of the base plate 80 and orthopedic appliance 90 is preferred, a possible embodiment of the present invention could be constructed by securing the orthopedic appliance to the sole 20 by other means. For instance, an orthopedic appliance, such as 90, could be cemented to the top surface 32. In such case the second outer peripheral edge 12 of insole 10 would be located in groove 25 alone. Such an embodiment would not be preferred, however, in that once an orthopedic appliance is permanently secured to the top surface 32, it can no longer be moved. It is preferred that the method of attachment of the orthopedic appliance, such as illustrated at 90 should permit a revised placement of the appliance, should the components of the orthopedic sandal 1 of the present invention stretch after an initial wearing period. Moreover, it is possible to construct an embodiment of the present invention in which the insole 10 is attached to sole 20 by means other than the groove 25 located within the sidewall 34. For instance sidewall 34 could be deleted and the insole 10 could be sized to cover the top surface 32 and then be cemented in place. Such an embodiment of the present invention would not be preferred in that a revised placement of the orthopedic appliance would thereby be prevented.

Figure 8:
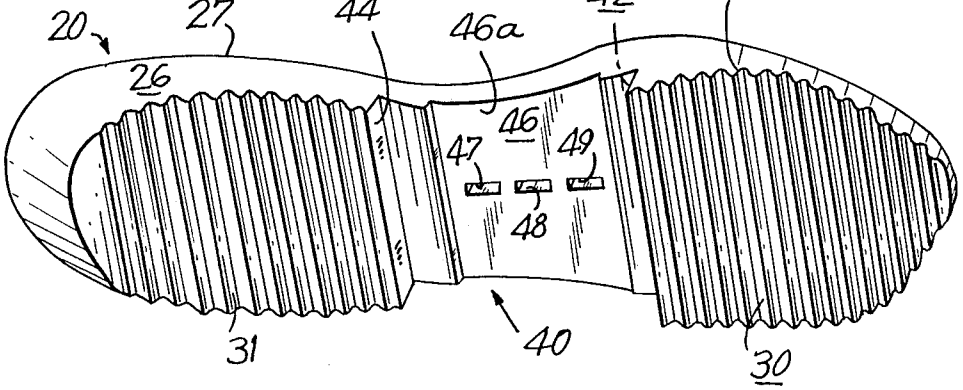
FIG. 8 is a bottom, right side perspective view of a sole used in the sandal of FIG. 1 with a central member of the present invention removed.
Figure 9:
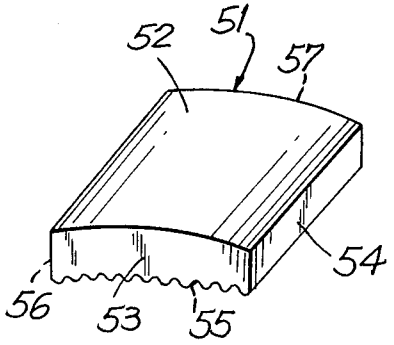
FIG. 9 is a right side perspective view of a detachable central member of the sandal of FIG. 1.

Referring now to FIGS. 8 and 9, the sole 20 preferably secured to a foot of a user by means of an arch strap 60 connected to a detachable central member 50 located within a channel 40 of the sole 20. The channel 40 extends through the lateral surface 26 on opposite sides of the sole 20. The channel 40 is defined in bottom surface 30 and is located along the length of the sole so as to underlie the arch of the foot. The channel 40 can be defined by a pair of front and rear end surfaces 42 and 44 and a base surface 46. End surfaces 42 and 44 vertically extend from the bottom surface 30 towards the base surface 46 located at the depth of the channel 40. The central member 50 is configured to be located in the channel 40 in a close fitting relationship. The central member 50 can comprise two elements. The first element 51 preferably has a set of six interconnected faces. A pair of front and rear faces, respectively 54 and 56, are configured to lie flush against the front and rear end surfaces 42 and 44. A top face 52 underlies the base surface 46. A bottom face 55 is located opposite to the top face 52 and is configured to be contiguous with bottom surface 30. A pair of opposed lateral faces 53 and 57 are configured to be contiguous with portions of the outer lateral surface 26 located on opposite sides of the sole member 20. With reference now also to FIG. 4, an optional second element 58 can be included as illustrated by the broken lines. The optional second element 58 depends from the bottom face 55 and is integrally formed from the bottom face 55. As illustrated, the second element 58 is a wedge-like solid having a lower inclined surface 59 that slopes towards the top face 52 in a direction taken from the front face 52 to the rear face 56. The width of the second element 58 is preferably equal to that of the bottom face 55. Further, the second element 58 preferably is centrally spaced on the bottom face 55.

Figure 7:
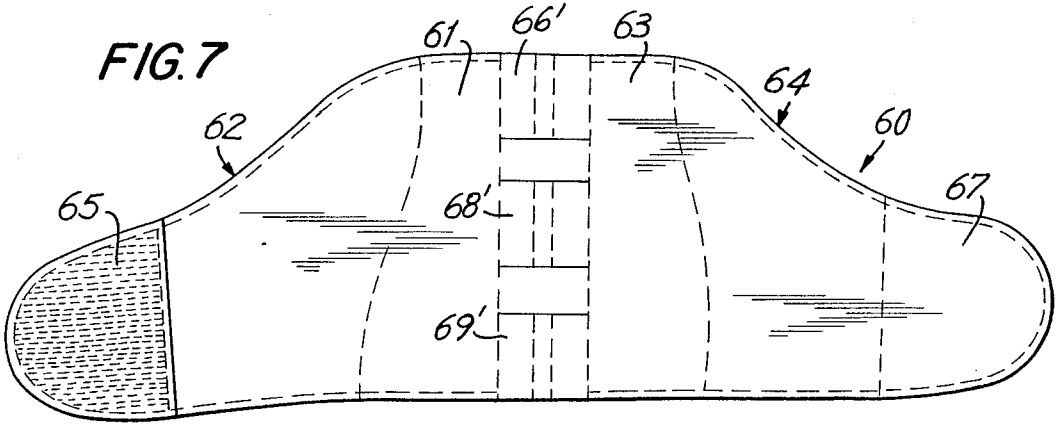
FIG. 7 is a top plan view of an arch strap of the present invention utilized in the modular orthopedic sandal illustrated in FIG. 1.

With reference to FIGS. 4 and 7 the arch strap 60 has a pair of elongated, flexible strap sections 62 and 64. Strap sections 62 and 64 are respectively connected at ends 61 and 63 to sole 20. Ends 61 and 63 are operable to be located between top face 52 and base surface 46 when central member 50 is installed within channel 40. The strap sections 62 and 64 are oriented so that the other ends 65 and 67 thereof extend in opposite directions, and when the central member 50 is installed, from opposite sides of sole 20. The strap sections 62 and 64 have means, located at the other ends 65 and 67, for releasably and adjustably securing strap sections 62 and 64 together at the ends 65 and 67. These means in a preferred embodiment can comprise hook and fleece materials such as VELCRO. The arch strap 60 is preferably cemented to the top face 54 of the central member 50. As illustrated in FIG. 7, the arch strap sections 62 and 64 can be connected to one another by elements 66', 68', and 69', which can be gathered into pleats to produce the loops 66, 68 and 69 for purposes that will become apparent.

The central member 50 can preferably be secured within channel 40 by either one of two means. With reference now to the embodiment illustrated in FIG. 1, and with particular reference to FIGS. 3 and 4, the sole 20 is provided with a set of three slots 47, 48 and 49. Slots 47, 48, 49 are spaced apart from one another in a direction parallel with the length of the sole 20. The slots 47, 48, and 49 communicate between the base surface 46 and the top surface 32. The set of three upstanding loops 66, 68, and 69 are connected to the top face 54 by way of the cemented arch strap 60. Loops 66, 68, 69 are spaced apart from one another to align with the slots 47, 48, and 49 when the central member 50 is located within the channel 40. The loops 66, 68, and 69 preferably have a height equal to the distance separating the top surface 32 from the base surface 54. An elongated cylindrical, attachment rod 70 is provided. The attachment rod 70 has a diameter sized to extend through the loops 62, 64, and 66 and a length at least equal to the combined length of the slots 47, 48, and 49 and the spacing between the slots. In order to attach the central member 50 and the arch strap 60 to the sole 20, the central member 50 is placed within the channel 40 with the loops 66, 68 and 69 extending through the channels 46, 47 and 49. The top surface 32 can then be manually depressed and the rod 70 can be inserted through the loops 66, 68 and 69. The rod 70 thus bears the portions of the top surface between the slots 47, 48, and 49. With reference to FIG. 4, recess 45 is optionally defined in the top surface 32. In such case, the rod 70 is sized to also fit within the recesses 45. The purpose of the recess 45 is to prevent movement of the rod member 70.

The central member 50 can further be releasably attached to the sole 20 by providing a releasably attachment between the portions of outer lateral surface 26 located directly above the channel 40 and an opposite sides of sole 20. This releasable attachment is again preferably accomplished by means of hook and fleece-like materials, such as Velcro. The materials are connected to a portion of the outer lateral surface 26 located above the channel 40 and below the top peripheral edge 27 and on a portion of the arch strap 60 located adjacent to and on the outside of the channel 40. In the illustrated preferred embodiment three spaced, square-like elements 72, 74 and 76, formed of the hook or fleece material are connected to the lateral surface 26. A strip-like element 78 of complementary material is preferably connected to the strap 60.

Arch strap 60 can function with arch support 50 to provide added support to the arch of the foot. To this end, arch strap 60 should be formed from an inelastic material to thus, further stiffen the portion of sole 20 to be located below the arch of the foot. Such a material is preferably canvas. In this regard, when an inelastic arch strap is used the arch strap 60 should be releasably secured to said sole 20, within channel 40 to transmit the stiffness of strap 60 to sole 20. It is understood, however, that the present invention includes a possible, though not very desirable embodiment, having an arch strap connected to sole 20 by being sandwiched between central member 50 and base surface 46. The optional second element 57 adds further support by upwardly bowing the sole 20 when the user stands on sole 20. The amount of support added by second element 57 can be adjusted by varying the height of second element 57.

Figure 6:
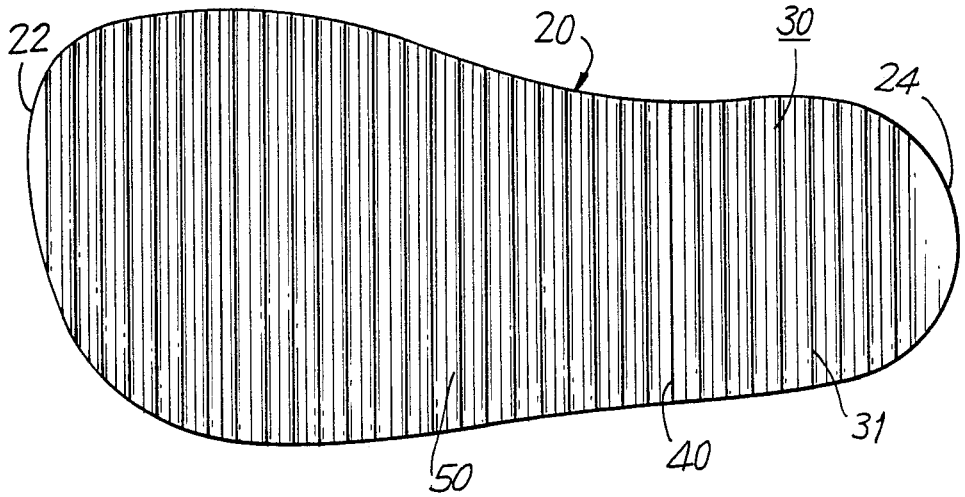
FIG. 6 is a bottom plan view of FIG. 5.
Figure 13:
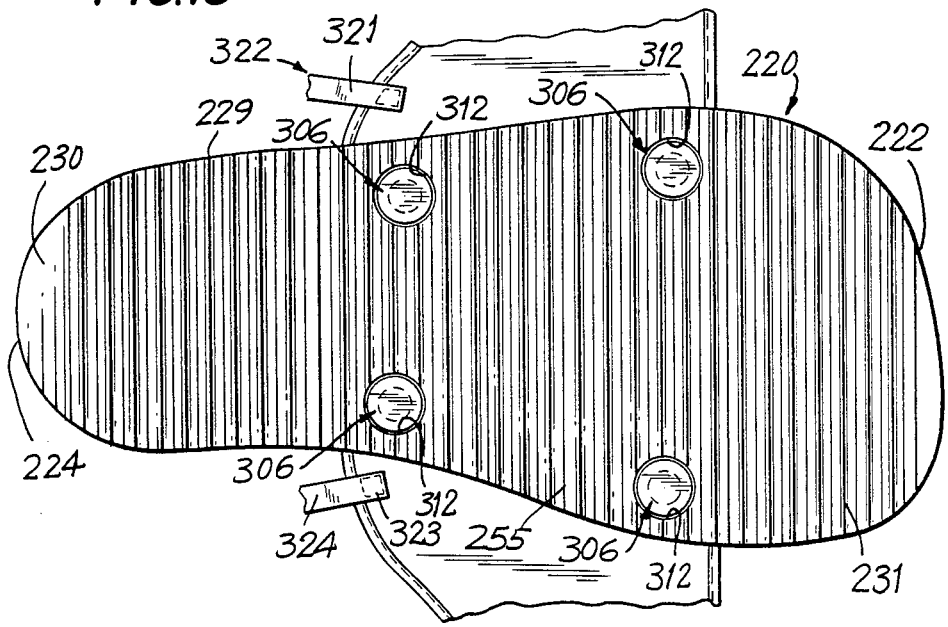
FIG. 13 is a bottom plan view of FIG. 10.
Figure 15:
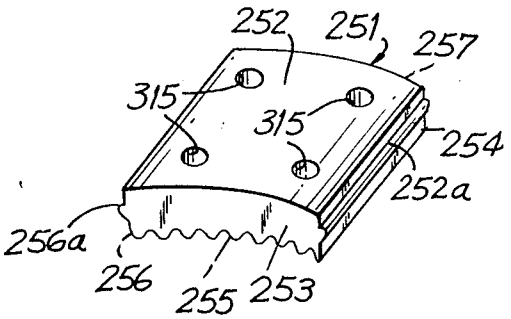
FIG. 15 is a right side perspective view of a detachable central member of the sandal of FIG. 2.
Figure 14:
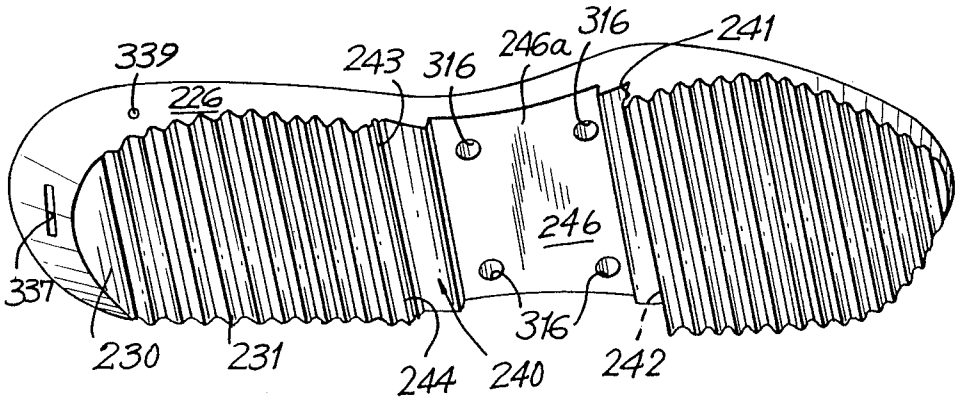
FIG. 14 is a bottom, right side perspective view of a sole used in the sandal of FIG. 2 with a central member of the present invention removed.
Figure 16:
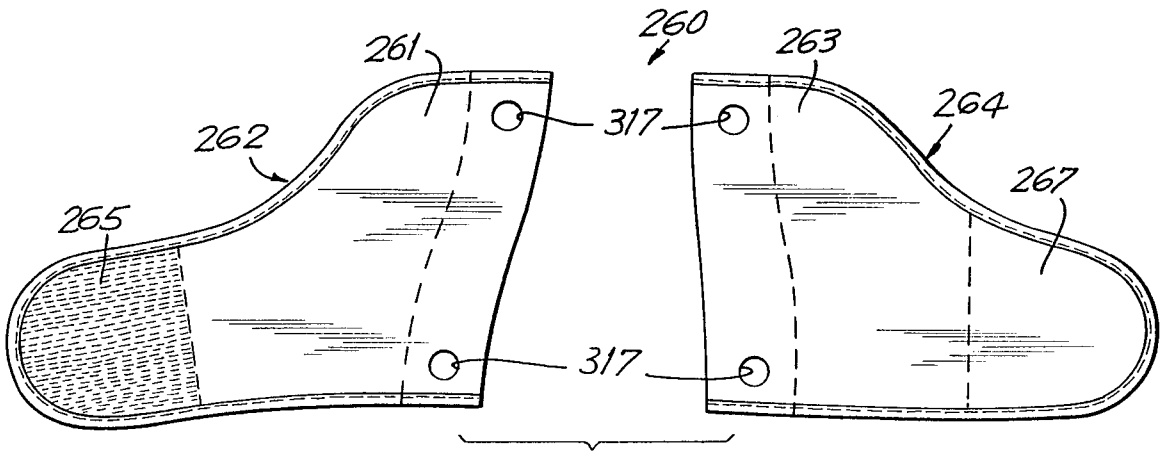
FIG. 16 is a top plan view of the arch strap of the present invention utilized with the embodiment illustrated in FIG. 2.

Referring again to FIG. 2, the sandal 2 differs from sandal 1 mainly in the method utilized in attaching its detachable central member 250 and arch strap 260 and the addition of a heel strap 320, an ankle strap 330 and a heel strut 340. There are however, many of the same design features incorporated in both of the embodiments. With reference also now to FIGS. 10 and 11 an insole 200 is provided that could alternately be used with the embodiment illustrated in FIG. 1. The difference between the two illustrated insoles is related to their method of fabrication. Insole 200 is fabricated from a foam rubber 201 covered with cloth 203. With additional reference to FIGS. 12 and 13, sole 220 has a length as measured between its ends 222 and 224. Sole 220 also has an outer lateral surface 226 having an upper periperal edge 227 and a lower peripheral edge 229. A bottom surface 230 is provided that is formed by the lower peripheral edge 229 of the sole 220. Sole 220 has a top surface 232, spaced above the bottom surface 230 and recessed below the upper peripheral edge 227. Sidewall 234 is identical to sidewall 34 of the embodiment illustrated in FIG. 1. An insole-like base plate 280 having an independently attached orthopedic appliance 290 can be provided. The insole 200 and the insole-like base plate 280 both have outer peripheral edges 202 and 282 that are configured to be aligned with one another and to seat within groove 225 of sidewall 234. With reference to FIGS. 13 and 14, the bottom surface 230 can also be provided with a transverse channel 240 identical in placement, and for the most part configuration, to the channel 40. Channel 240 is also provided with front and rear end surfaces 242 and 244 and a base surface 246 that define the channel 240. These aforementioned surfaces directly correspond to the front, base and rear end surfaces 42, 46, and 44. A detachable central member 250 and arch strap 260 can also be provided. The central member 250 can also be formed from two elements. The first element 251 has a set of 6 interconnected faces that include a front face 254, a rear face 256, a top face 252, a bottom face 255, and lateral faces 253 and 257, all of which, in the main, correspond to the faces 54,56, 52, 55, 53 and 57 of the embodiment of FIG. 1. An additional, optional second element 258 comprising a wedge-like solid can be provided that corresponds to the second element 58 of the embodiment of FIG. 1. A comparison of FIGS. 8 and 13 show that the thickness of both the soles 20 and 220 gradually increases respectively from one end, 22 or 222, to the other end, 24 or 224. The purpose of this is to form a heel portion at the other thicker end 24 or 224 and a toe portion at the thinner end 22 or 222. Also as illustrated in FIGS. 6 and 13 the bottom surfaces 30 and 230 can be provided with a plurality of ridges 31 and 231 to form a tread.

Referring now to FIGS. 11 and 14, the sole member 220 is secured to the foot of the user by means of an arch strap 260 that can have the same additional stiffening function of strap 60. As illustrated the arch strap sections 262 and 264 are respectively spaced from one another rather than adjacent to one another as with strap sections 62 and 64. The orientation and placement of the ends 261, 263, 265, and 267 are the same as ends 61, 63, 65, and 67 of arch strap 60. The connection of ends 261 and 263 to sole 220 is however, accomplished by means of a set of four connection members 300 that extend through a set of four countersunk bores 310 communicating between the bottom face 255 and the top surface 232. It is appropriate to point out here that an arch strap member such as illustrated at 60, without the loops, could be utilized. Additionally, both of the channels 40 and 240 can optionally be provided with recesses 46*a* and 246*a* (as illustrated in FIGS. 8 and 14) to recess the arch strap 60 and 260 within respective base surfaces 46 and 246. It is further understood that the strap sections 262 and 264 could also be cemented in place for added strength. In any embodiment, the combined length of strap sections 262 and 264 is sized to encircle the foot of the user with the ends 265 and 267 thereof overlaping. The ends 265 and 267 of the arch strap sections 262 and 264 are preferably releasably and adjustably secured to one another by means of complimentary hook and fleece materials respectively attached to the ends 265 and 267.

With reference now to FIGS. 10 through 14 inclusive, the central member 250 is releasably secured within the channel 240 by means of the connection members 300. As discussed previously, the connection members 300 also serve to connect the arch strap sections 262 and 264 to the sole 220. In order to accomplish this releasable connection sole 220 has a set of four countersunk bores illustrated as 310. Each bore 310 has an enlarged countersunk portion 312 that is defined in bottom face 255 and that has a circular, transverse cross-section. The narrow portion 314 also has a circular, transverse cross section. Portion 314 coaxially extends from countersunk portion 312 to top surface 232. Each of the narrow portions 314 has a set of three coaxial sections 315, 316, and 317 that are aligned with one another when strap sections 262 and 264 and central member 250 are installed within channel 240. The first of the sections, 315 is located within the central member 250 and communicates between bottom face 255 and top face 252. The second of the sections 316 is located in sole 220 and communicates between the top surface 232 and base surface 246. The third of the sections 317 is located in the arch strap sections 262 and 264 and communicates between the sections 315 and 316. The bores 310 are spaced apart from one another so that a pair of the third sections 317 are defined at the ends 261 and 263 of strap sections 262 and 264, transversely spaced apart from one another.

Figure 12:
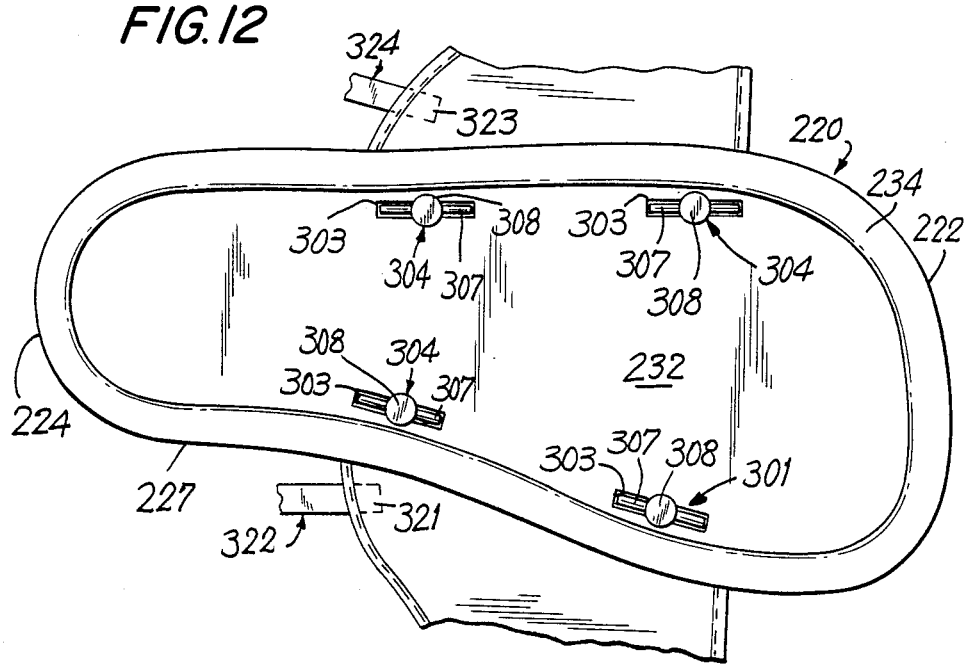
FIG. 12 is a fragmentary, top plan view of the sole of the present invention utilized in the embodiment illustrated in FIG. 2.
Figure 17:
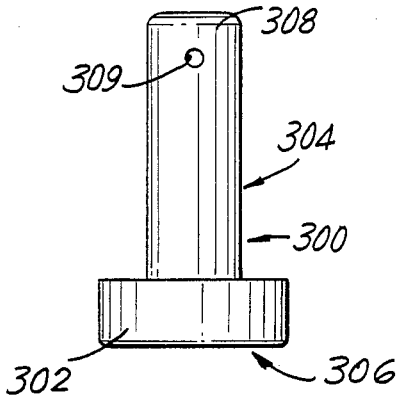
FIG. 17 is a side elevational view of the connection member of the present invention utilized in the embodiment illustrated in FIG. 2.

Referring now to FIGS. 12 and 17, each of the connection members 300 has an enlarged head 306, located at one end 302, having a circular, transverse cross section sized to closely fit within a countersunk portion 312 of a countersunk bore 310. Additionally, each of the connection members 300 has a stem 304 with a circular, transverse cross section sized to closely fit within a narrow portion 314 of a countersunk bore 310. The stem 304 is coaxially connected to the enlarged head 306 and has a length sized to extend through the narrow portion 314, when the central member 250 is located within the channel 240. The stem 304 also has, at the other end 308 of the attachment member 300, a transversely oriented hole 309, diametrically communicating between the outer circumferential surface of the stem 304. A set of four shear pins 307 are also provided. Each of the pins 307 has a transverse cross section sized to fit within a hole 309 and a length greater than the diameter of the narrow portion 314. In order to attach the central member 250 and arch strap 260 within the channel 240, the central member 250 is inserted within the channel 240 with the strap sections 262 and 264 located between base surface 244 and central member 250. A connection member 300, stem 304 first is extended through the countersunk bore 310, and the sections 317 of the arch strap sections 262 and 264. The top surface 232 is then manually depressed around the connection member 300 until the hole becomes visible. At this point, the shear pin 307 is inserted in the hole 309 to thus secure the attachment member 300 in place. As illustrated a set of depressions 303 can be optionally provided in the top surface 232. Each of the depressions 303 has the length of a shear pin 307 and a depth equal to the diameter of a shear pin 307. The depression 303 prevents movement of the shear pin 307 from the hole 309.

It is appropriate to point out here that the arch straps 260 and 60 can be provided in any conceivable color or with a printed pattern. Since the arch straps 60 and 260 are easily removable, the straps 60 and 260 can be removed and replaced, as is necessary, to coordinate, in a fashion sense, with the clothes of the wearer.

Referring to FIGS. 2, 10, 13 and 14 an additional optional releasable attachment can be provided for the central member 250. As illustrated the front end surface 242 can be provided with a transversely oriented front notch 241, extending along front end surface 242 and through outer lateral surface 226 on opposite sides of the sole 220. The rear end surface 244 can similarly be provided with a transversely oriented rear notch 243. The central member 250 can also be provided with a pair of front and rear projections 252*a* and 256*a*. Front projection 252*a* is located along and integrally formed from the front face 252 and the rear projection 256*b* is located along and integrally formed from the rear face 256. The front projection 252*a* is configured to closely fit within the front notch 241 when the central member 250 is located within the channel 240. Similarly, the rear projection 256*a* is configured to closely fit within the second notch 243. It is understood that the arrangement of notch 241 and 243 and the projections 252*a* and 256*b* is optionally included to insure a secure attachment between the central member 250 and the sole 220.

Figure 18:
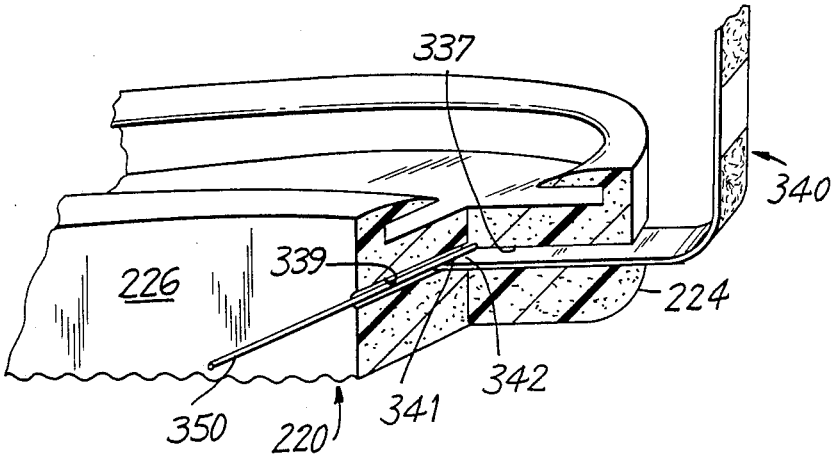
FIG. 18 is a fragmentary, perspective view of the sole of the present invention utilized in the embodiment of FIG. 2, with a portion of the sole cut away to show the attachment of a heel strut of the present invention.

The orthopedic sandal 2 of the embodiment illustrated in FIG. 2 can also optionally include an arrangement of heel and ankle straps 320 and 330 and a heel strut 340 to more securely attach the illustrated sandal 2 to the foot of the wearer. With reference again to FIGS. 2, 12 and 13 the preferred heel strap 320 has a pair of separable and adjustable heel strap segments 322 and 324. Segment 322 is shorter than segment 324. Each of the heel strap segments are respectively attached at ends 321 and 323 to the arch strap sections 264 and 262. The heel strap segments 322 and 324 have a combined length and an orientation to encircle the apex of the heel of the foot when the foot is placed on the insole 200. The opposite ends 326 and 328 are preferably releasably and adjustably secured to one another by means of complementary hook and fleece materials, such as Velcro, respectively located on the ends 326 and 328. The ankle strap 330 has a pair of separable and adjustable ankle strap segments such as illustrated longer segment 332 and shorter segment 334. Segment 334 is attached, at end 333, to shorter segment 322 at the end 326 thereof. Segment 332 is attached, at end 331, to the longer heel strap segment 324 at a location 339 opposite to the point of attachment of the shorter heel and ankle strap segments 322 and 334. The ankle strap segments 332 and 334 have an orientation and combined length to encircle the instep of the foot when the foot is placed on the insole 200. The other ends, 336 and 338 of segments 332 and 334 are provided with a releasable and adjustable attachment by the preferred means of complementary hook and fleece materials respectively located on ends 336 and 338. With reference now also to FIG. 18, the sole 220 has a horizontal slot 337 in the thicker end 224 of the sole 220. Slot 337 extends inwardly from the outer lateral surface 226 towards the thinner end 222 of the sole 220. A transverse bore 339 extends through the outer lateral surface 226 on opposite sides of the sole 220. The horizontal slot 337 intersects the transverse bore 339. The heel strut 340 has a planar, elongated configuration. Heel strut 340 has a loop 341 integrally formed at end 342. The heel strut member 340 has a length, width and thickness sized such that strut 340 is operable for extension into slot 337, end 342 first, with loop 341 located in transverse bore 339. Additionally, the heel strut can be folded by the other end 344 over the heel strap 320, at the apex of the heel, with end 344 located against a location 346 situated along the length of the heel strut 340. An elongated securement member 350 is provided to extend through the transverse bore 339 and the loop 341 to releasably connect the heel strut 340 to the sole 220. The securement member 350 has a length equal to the transverse bore 339 and a cross section sized to closely fit within the transverse bore 339 and the loop 341. The end 349 and the location 346 can similarly be provided with a releasable and adjustable attachment by way of the preferred means of appropriately located hook and fleece materials.

Although VELCRO is the preferred method of accomplishing a releasable and adjustable attachment of the various components of the illustrated, preferred embodiment, it is understood that the means utilized could simply be a releasable means such as a single snap arrangement. For instance, the ends 265 and 267 of the arch strap 260 could be provided with a single snap.

While specific embodiments of the inventions have been shown and described, the invention should not be considered as limited, but as limited only as set forth in the appended claims.

I claim:

1. A modular orthopedic sandal comprising;

a flexible insole;

a resilient, flexible sole operable to be releasably attached to said insole, said sole including, a length as measured between the ends of said sole, an outer lateral surface having, a lower peripheral edge, and an upper peripheral edge, spaced above said lower peripheral edge, a bottom surface bounded by said lower peripheral edge, a top surface spaced above said bottom surface and recessed below said upper peripheral edge, an upstanding sidewall having, an inner surface surrounding and adjacent to said top surface, a top peripheral edge formed by said upper peripheral edge, an outer surface formed by a portion of said outer lateral surface located between said upper peripheral edge and said top surface, and means for releasably attaching said insole to said sidewall above said top surface, and means for releasably securing said sole to a foot of a user;

at least one orthopedic appliance operable to be located between said insole and said top surface of said sole and surrounded by said sidewall; and means for attaching an orthopedic appliance to said sole below said insole, said inner surface has an inner, peripherally extending groove, level with said top surface and oriented outwardly towards said outer surface, said insole member has a first outer peripheral edge configured to seat within said groove, said groove comprising said insole releasable attachment means, said one orthopedic appliance has a plurality of small U-shaped wires having central portions embedded in said appliance in a downward direction; and said orthopedic appliance attachment means comprises a base plate operable to be located below said orthopedic appliance and against said top surface, said base plate having a second outer peripheral edge configured to align with said first outer peripheral edge when said base plate is located below said insole and to be seated within said groove with said first outer peripheral edge and a tangible grid of regularly spaced, hole-like mounting sites, through which said extending portions project and are crimped against said base plate, said bottom surface has a transversely oriented channel, extending through said outer lateral surface on opposite sides of said sole and at right angles to said length, said channel being located along said length of said sole so as to underlie the arch of a said foot, said channel being defined by a pair of spaced, front and rear end surfaces, vertically extending from said bottom surface towards said top surface and a base surface underlying said top surface, connecting said front and rear end surfaces at the depth of said channel; said foot releasable securement means comprises a detachable central member configured closely fit within said channel, said central member comprising at least a first element having set of six interconnected faces that include, a pair of opposed, spaced front and rear faces that are configured to respectively lie flush against said front and said rear end surfaces, a top face that underlies said base surface, a bottom face that is located opposite to said top face and is configured to be contiguous with said bottom surface, and a pair of opposed, spaced lateral faces that are configured to be contiguous with said outer lateral surface on opposite sides of said sole, means for releasably connecting said central member to said sole within said channel, an inelastic arch strap located within said channel to releasably attach said sole to said foot and to stiffen said sole to provide support for the arch of said foot, said arch strap including a pair of elongated, flexible strap sections, each of which, at one end, is connected to said sole, and each of which, at said one end, is operable to be located between said top face and said base surface when said central member is installed within said channel, said strap sections being oriented so that the other ends thereof extend in opposite directions and when said central member is installed, from opposite sides of said sole, said strap sections having means located at the said other ends of each of said strap sections for releasably and adjustably securing said strap sections together at their said other ends and a combined length to encircle said foot with the said other ends of each of said strap sections overlapping, and means for releasably connecting said strap sections to said sole at their said one ends, within said channel, said sole has a set of three vertical slots spaced apart from one another in a direction parallel with said length of said sole member, said slots being centrally located on said sole and communicating between said base surface and said top surface; said strap sections, at their said one ends, are adjacent to one another and are connected to said top face of said central member; and said central member releasable connection means and said strap sections releasable connection means comprise, a set of three upstanding loops integrally formed from said one ends of said strap sections, connecting said strap sections to one another, said loops being spaced apart from one another so as to align with said slots when said central member is located within said channel, said loops having a height equal to the distance separating said top surface from said base surface, and an elongated, cylindrical attachment rod having, a diameter sized to extend through said loops, and a length at least equal to the combined length of said slots and the spacing between said slots, whereby said central member is operable to be releasably connected to said sole within said transverse channel, with said loops extending through said slots, said rod extending through said loops at said top surface and said rod bearing at least against the portions of the top surface located between said slots.

2. The modular orthopedic sandal of claim 1, wherein said central portion further comprises a second element comprising a wedge-like solid having, a lower inclined face that slopes towards said top face in a direction taken from said front face to said rear face, a width equal to that of said bottom face, and a length less than that of said bottom face, said second element being centrally located on said bottom face.

3. The orthopedic sandal of claim 1 wherein said central member and said strap section releasable connection means further includes means for releasably securing said strap sections to a pair of opposite portions of said outer lateral surface located adjacent to and direction above said channel on opposite sides of said sole.

4. The modular orthopedic sandal of claim 3 wherein said sole member has a thickness, defined by the distance separating said top surface from said bottom surface, that gradually increases between the ends of said sole.

5. The orthopedic sandal of claim 4 wherein said bottom surface has a plurality of ridges to form a tread on said bottom surface.

6. A modular orthopedic sandal comprising:

a flexible insole;

a resilient, flexible sole operable to be releasably attached to said insole, said sole including, a length as measured between the ends of said sole, an outer lateral surface having, a lower peripheral edge, and an upper peripheral edge, spaced above said lower peripheral edge, a bottom surface bounded by said lower peripheral edge, a top surface spaced above said bottom surface and recessed below said upper peripheral edge, an upstanding sidewall having, an inner surface surrounding and adjacent to said top surface, a top peripheral edge formed by said upper peripheral edge, an outer surface formed by a portion of said outer lateral surface located between said upper peripheral edge and said top surface, and means for releasably attaching said insole to said sidewall above said top surface, and means for releasably securing said sole to a foot of a user;

at least one orthopedic appliance operable to be located between said insole and said top surface of said sole and surrounded by said sidewall; and means for attaching an orthopedic appliance to said sole below said insole, said inner surface has an inner, peripherally extending groove, level with said top surface and oriented outwardly towards said outer surface, said insole member has a first outer peripheral edge configured to seat within said groove, said groove comprising said insole releasable attachment means, said one orthopedic appliance has a plurality of small U-shaped wires having central portions embedded in said appliance in a downward direction; and said orthopedic appliance attachment means comprises a base plate operable to be located below said orthopedic appliance and against said top surface, said base plate having a second outer peripheral edge configured to align with said first outer peripheral edge when said base plate is located below said insole and to be seated within said groove with said first outer peripheral edge and a tangible grid of regularly spaced, hole-like mounting sites, through which said extending portions project and are crimped against said base plate, said bottom surface has a transversely oriented channel, extending through said outer lateral surface on opposite sides of said sole and at right angles to said length, said channel being located along said length of said sole so as to underlie the arch of a said foot, said channel being defined by a pair of spaced, front and rear end surfaces, vertically extending from said bottom surface towards said top surface and a base surface underlying said top surface, connecting said front and rear end surfaces at the depth of said channel; said foot releasable securement means comprises, a detachable central member configured closely fit within said channel, said central member comprising at least a first element having set of six interconnected faces that include, a pair of opposed, spaced front and rear faces that are configured to respectively lie flush against said front and said rear end surfaces, a top face that underlies said base surface, a bottom face that is located opposite to said top face and is configured to be contiguous with said bottom surface, and a pair of opposed, spaced lateral faces that are configured to be contiguous with said outer lateral surface on opposite sides of said sole, means for releasably connecting said central member to said sole within said channel, an inelastic arch strap located within said channel to releasably attach said sole to said foot and to stiffen said sole to provide support for the arch of said foot, said arch strap including a pair of elongated, flexible strap sections, each of which, at one end, is connected to said sole, and each of which, at said one end, is operable to be located between said top face and said base surface when said central member is installed within said channel, said strap sections being oriented so that the other ends thereof extend in opposite directions and when said central member is installed, from opposite sides of said sole, said strap sections having means located at the said other ends of each of said strap sections for releasably and adjustably securing said strap sections together at their said other ends and a combined length to encircle said foot with the said other ends of each of said strap sections overlapping, and means for releasably connecting said strap sections to said sole at their said one ends, within said channel, said strap sections are spaced apart from one another; said sole has a set of four countersunk bores communicating between said bottom face and said top surface, each of said bores having, an enlarged countersunk portion, defined in said base surface, having a circular, transverse cross section, and a narrow portion, having a circular, transverse cross section, coaxially extending from said countersunk portion to said top surface, said narrow portion having a set of three coaxial sections that are aligned with one another when said strap sections and said central member are installed within said channel, the first of said sections being located within said central member, communicating between said enlarged bore and said top face, the second of said sections being located within said sole, communicating between said top surface and said base surface, and the third of said sections being located within said arch strap section, communicating between said first and said second bores, said countersunk bores being spaced apart from one another so that a pair of said second sections are defined at said one end of each of said strap sections, transversely spaced apart from one another; and said central member and said strap section releasable connection means comprise, a set of four connection members, each of which has, an enlarged head located at one end, having a circular, transverse cross section sized to closely fit within said countersunk portion of said bore, a stem having a circular, transverse cross section sized closely to fit within said narrow portion of said bore, said stem being coaxially connected to said enlarged head and having a transverse hole, located at the other end of said connection member, diametrically communicating between said circumferential surface of said stem and a length equal to that of said narrow portion, and a set of four shear pins each of which has a transverse cross sized to fit within a said transverse hole of a said connection member and a length greater than the diameter of a said narrow portion, whereby each of said connection members is operable to be located within a said countersunk bore with its said enlarged head located within a said countersunk portion and its said stem located in said narrow portion and each of said shear pins is operable to extend through a said transverse hole of a said connection member with the ends of a said shear pin bearing against said top surface.

7. The orthopedic sandal of claim 6 wherein: said front end surface further has a transversely oriented, elongated front notch, extending along said front end surface and through said outer lateral surface on opposite sides of said sole; said rear end surface further has a transversely oriented, elongated rear notch, extending along said rear end surface and through said outer lateral surface on opposite sides of said sole; and said central member releasable connection means further includes, a front projection located along and integrally formed from said front face, said front projection configured to closely fit within said front notch when said arch support members are located within said channel, and a rear projection located along and integrally formed from said rear face, said rear projection configured to closely fit within said rear notch when said arch support member is located within said channel.

8. The orthopedic sandal of claim 7 wherein said sole has a thickness, as measured between said top and bottom surfaces, that gradually increases between the ends of said sole to form a thicker end and a thinner end of said sole.

9. The orthopedic sandal of claim 8 wherein:

said outer lateral surface, at aid thicker end of said sole, has a horizontal slot extending towards said thinner ends of said sole;

said sole has a transverse bore communicating through said outer lateral surface on opposite sides of said sole, said tranverse bore being spaced from said thicker end of said sole to intersect said slot;

a heel strap having a pair of separable and adjustable heel strap segments, one of which is shorter than the other and each of which is attached, at one end, to a said strap section, said heel strap segments having an orientation and a combined length that is sized to encircle the apex of the heel of said foot, when said foot is placed on said insole, and means, connected to the other of the ends of said heel strap segments, for releasably and adjustably securing said other ends of said heel strap segments to one another;

an ankle strap having a pair of separable and adjustable ankle strap segments, one of which is shorter than the other, the shorter of which is attached, at one end, to the said other end of the shorter of said ankle strap segments, the longer of which is attached, at one end, to the longer of said heel strap segments at a location thereof opposite to the point of attachment of said shorter ankle and heel strap segments, said ankle strap segments having an orientation and combined length that is sized to encircle the instep of said foot and means, connected to the other of the ends of said ankle strap segments, for releasable and adjustably securing the said other of the ends of said ankle strap segments to one another; and an elongated flexible, planar heel strut having, a loop integrally formed at one end, a length, width and thickness sized such that said strut, loop first, is operable to be inserted within said slot with said loop located within said transverse bore and such that said heel strap is operable to be folded, by the other of its ends, over said heel strap, with its said other end against a location of said heel strut situated along said length of said heel strut, and means for releasably and adjustably securing said other end of said heel strut to said location of said heel strut, and an elongated securement member having a length equal to said transverse bore, said securement member being operable to extend through said transverse bore and said loop to releasably connect said heel strut to said sole.

10. The orthopedic sandal of claim 9 wherein said bottom surface has a plurality of ridges to form a tread on said bottom surface.

11. A modular orthopedic sandal comprising;

a flexible insole;

a resilient, flexible sole operable to be releasably attached to said insole, said sole including, a length as measured between the ends of said sole, an outer lateral surface having, a lower peripheral edge, and an upper peripheral edge, spaced above said lower peripheral edge, a bottom surface bounded by said lower peripheral edge, means for releasably attaching said insole to said sole, and means for releasably securing said sole to a foot of a user;

said bottom surface has a transversely oriented channel, extending through said outer lateral surface on opposite sides of said sole and at right angles to said length, said channel being located along said length of said sole, said channel being defined by a pair of spaced, front and rear end surfaces, vertically extending from said bottom surface towards said top surface and a base surface underlying said top surface, connecting said front and rear end surfaces at the depth of said channel;

said foot releasable securement means comprises, a detachable central member configured to closely fit within said channel, said central member comprising at least a first element having set of six interconnected faces that include, a pair of opposed, spaced front and rear faces that are configured to respectively lie flush against said front and said rear end surfaces, a top face that underlies said base surface, a bottom face that is located opposite to said top face and is configured to be contiguous with said bottom surface, and a pair of opposed, spaced lateral faces that are configured to be contiguous with said outer lateral surface on opposite sides of said sole, means for releasably connecting said central member to said sole within said channel, an arch strap located within said channel to releasably attach said sole to said foot and to stiffen said sole to provide support for the arch of said foot, said arch strap including a pair of elongated, flexible strap sections, each of which, at one end, is connected to said sole, and each of which, at said one end, is operable to be located between said top face and said base surface when said central member is installed within said channel, said strap sections being oriented so that the other ends thereof extend in opposite directions and when said central member is installed, from opposite sides of said sole, said strap sections having means located at the said other ends of each of said strap sections for releasably and adjustably securing said strap sections together at their said other ends, and a combined length to encircle said foot with the said other ends of each of said strap sections overlapping, and means for releasably connecting said strap sections to said sole at their said one ends, within said channel, said sole having a plurality of vertical slots spaced apart from one another in a direction parallel with said length of said sole member, said slots being centrally located on said sole and communicating between said base surface and said top surface;

said strap sections, at their said one ends, are adjacent to one another and are connected to said top face of said central member; and said central member releasable connection means and said strap sections releasable connection means comprise, a plurality of upstanding loops integrally formed from said one ends of said strap sections, connecting said strap sections to one another, said loops being spaced apart from one another so as to align with said slots when said central member is located within said channel, said loops having a height equal to the distance separating said top surface from said base surface, and an elongated, cylindrical attachment rod having, a diameter sized to extend through said loops, and a length at least equal to the combined length of said slots and the spacing between said slots, whereby said central member is operable to be releasably connected to said sole within said transverse channel, with said loops extending through said slots, said rod extending through said loops at said top surface and said rod bearing at least against the portions of the top surface located between said slots.

12. The modular orthopedic sandal of claim 11 wherein said arch strap is fabricated from an inelastic material.

13. The modular orthopedic sandal of claim 11 wherein: said sole further includes;

an outer lateral surface having, a lower peripheral edge, and an upper peripheral edge, spaced above said lower peripheral edge; said top surface is recessed below said upper peripheral edge to form an upstanding sidewall having, a top peripheral edge formed by said upper peripheral edge, an outer surface formed by a portion of said outer lateral surface located between said upper peripheral edge and said top surface, and an inner surface surrounding and adjacent to said top surface, said inner surface having an inner, peripherally extending groove level with said top surface and oriented outwardly towards said outer surface; said bottom surface is bounded by said lower peripheral edge; and said insole member has a first outer peripheral edge configured to seat within said groove, said groove comprising said insole releasable attachment means.

* * * * *